US008550843B2

(12) United States Patent
Van Swearingen

(10) Patent No.: US 8,550,843 B2
(45) Date of Patent: Oct. 8, 2013

(54) TABBED CONNECTOR INTERFACE

(75) Inventor: Kendrick Van Swearingen, Woodridge, IL (US)

(73) Assignee: Andrew LLC, Hickory, NC (US)

( * ) Notice: Subject to any disclaimer, the term of this patent is extended or adjusted under 35 U.S.C. 154(b) by 116 days.

(21) Appl. No.: 13/294,586

(22) Filed: Nov. 11, 2011

(65) Prior Publication Data

US 2012/0129375 A1 May 24, 2012

Related U.S. Application Data

(63) Continuation-in-part of application No. 13/170,958, filed on Jun. 28, 2011, and a continuation-in-part of application No. 13/161,326, filed on Jun. 15, 2011, now Pat. No. 8,365,404, and a continuation-in-part of application No. 13/070,934, filed on Mar. 24, 2011, and a continuation-in-part of application No. 12/980,013, filed on Dec. 28, 2010, and a continuation-in-part of application No. 12/974,765, filed on Dec. 21, 2010, and a continuation-in-part of application No. 12/962,943, filed on Dec. 8, 2010, now Pat. No. 8,302,296, and a continuation-in-part of application No. 12/951,558, filed on Nov. 22, 2010, and a continuation-in-part of application No. 13/277,611, filed on Oct. 20, 2011, and a continuation-in-part of application No. 13/240,344, filed on Sep. 22, 2011.

(51) Int. Cl.
*H01R 9/05* (2006.01)

(52) U.S. Cl.
USPC ..... 439/578; 439/317

(58) Field of Classification Search
USPC ..... 439/315, 316, 317, 313, 312, 311, 439/578
See application file for complete search history.

(56) References Cited

U.S. PATENT DOCUMENTS

| | | | | |
|---|---|---|---|---|
| 3,271,726 | A * | 9/1966 | Pfendler | 439/76.1 |
| 3,701,965 | A | 10/1972 | DuRocher et al. | |
| 4,235,498 | A | 11/1980 | Snyder | |
| 4,340,269 | A | 7/1982 | McGeary | |
| 4,440,464 | A | 4/1984 | Spinner | |
| 4,464,001 | A | 8/1984 | Collins | |
| 4,502,748 | A | 3/1985 | Brush, Sr. et al. | |
| 4,519,661 | A | 5/1985 | Brush, Sr. et al. | |

(Continued)

OTHER PUBLICATIONS

Sang Min Lee, International Search Report, Jun. 19, 2012, Korean Intellectual Property Office, Daejeon Metropolitan City, Republic of Korea.

*Primary Examiner* — Hae Moon Hyeon
(74) *Attorney, Agent, or Firm* — Babcock IP, PLLC

(57) ABSTRACT

An electrical connector interface has a male portion and a female portion. The male portion provided with at least three outer diameter radial projecting connector tabs and a conical outer diameter seat surface at an interface end. A lock ring provided with a stop shoulder and at least three radial inward coupling tabs at the interface end seats around the male portion, the stop shoulder abutting the connector tabs, a tab seat provided between the coupling tabs and the stop shoulder. The female portion provided with at least three outer diameter radial projecting base tabs and an annular groove open to the interface end with an outer sidewall dimensioned to mate with the conical outer diameter seat surface. The base tabs engage the coupling tabs when the lock ring is rotated to insert the base tabs into the tab seat, retaining the outer diameter seat surface against the outer sidewall.

20 Claims, 10 Drawing Sheets

(56) References Cited

U.S. PATENT DOCUMENTS

| | | | | |
|---|---|---|---|---|
| 4,726,782 | A | 2/1988 | Hager et al. | |
| 4,737,119 | A | 4/1988 | Stieler | |
| 5,383,272 | A | 1/1995 | Mattingly et al. | |
| 5,431,580 | A | 7/1995 | Tabata | |
| 5,662,488 | A | 9/1997 | Alden | |
| 5,722,847 | A | 3/1998 | Haag | |
| 6,039,594 | A | 3/2000 | Zuppa | |
| 6,056,577 | A | 5/2000 | Blanchet | |
| 6,183,293 | B1 | 2/2001 | Kieninger | |
| 6,226,068 | B1 | 5/2001 | Arcykiewicz et al. | |
| 6,309,231 | B1 | 10/2001 | Gordon et al. | |
| 6,336,822 | B1 * | 1/2002 | Luzzoli | 439/315 |
| 6,428,354 | B1 | 8/2002 | Meyer et al. | |
| 6,666,701 | B1 | 12/2003 | Burkhardt et al. | |
| 6,685,493 | B2 | 2/2004 | Birkenmaier et al. | |
| 6,808,407 | B1 | 10/2004 | Cannon | |
| 6,811,423 | B2 | 11/2004 | Yoshigi et al. | |
| 6,884,099 | B1 * | 4/2005 | Cannon | 439/318 |
| 6,921,283 | B2 | 7/2005 | Zahlit et al. | |
| 7,077,677 | B2 | 7/2006 | Sanuki | |
| D576,344 | S | 9/2008 | Conroy | |
| 7,479,033 | B1 | 1/2009 | Sykes et al. | |
| 7,553,177 | B2 | 6/2009 | Antonini et al. | |
| 7,625,226 | B1 | 12/2009 | Gastineau | |
| 7,661,984 | B2 | 2/2010 | McMullen et al. | |
| 7,980,781 | B2 | 7/2011 | Trice | |
| 2005/0164525 | A1 | 7/2005 | Benson et al. | |
| 2012/0129375 | A1 * | 5/2012 | Van Swearingen | 439/314 |
| 2012/0302088 | A1 * | 11/2012 | Van Swearingen et al. | 439/378 |
| 2013/0065420 | A1 * | 3/2013 | Van Swearingen et al. | 439/372 |
| 2013/0065422 | A1 * | 3/2013 | Van Swearingen et al. | 439/378 |
| 2013/0102178 | A1 * | 4/2013 | Van Swearingen et al. | 439/314 |

* cited by examiner

TABBED CONNECTOR INTERFACE

CROSS REFERENCE TO RELATED APPLICATIONS

This application is a continuation-in-part of commonly owned co-pending U.S. Utility patent application Ser. No. 13/277,611, titled "Close Proximity Panel Mount Connectors" filed Oct. 20, 2011 by Kendrick Van Swearingen. This application is a continuation-in-part of commonly owned co-pending U.S. Utility patent application Ser. No. 13/240,344, titled "Connector and Coaxial Cable with Molecular Bond Interconnection" filed Sep. 22, 2011 by Kendrick Van Swearingen and James P. Fleming. This application is also a continuation-in-part of commonly owned co-pending U.S. Utility patent application Ser. No. 13/170,958, titled "Method and Apparatus For Radial Ultrasonic Welding Interconnected Coaxial Connector" filed Jun. 28, 2011 by Kendrick Van Swearingen. This application is also continuation-in-part of commonly owned co-pending U.S. Utility patent application Ser. No. 13/161,326, titled "Method and Apparatus for Coaxial Ultrasonic Welding Interconnection of Coaxial Connector and Coaxial Cable" filed Jun. 15, 2011 by Kendrick Van Swearingen. This application is also continuation-in-part of commonly owned co-pending U.S. Utility patent application Ser. No. 13/070,934, titled "Cylindrical Surface Spin Weld Apparatus and Method of Use by Kendrick Van Swearingen. This application is also a continuation-in-part of commonly owned co-pending U.S. Utility patent application Ser. No. 12/980,013, titled "Ultrasonic Weld Coaxial Connector and Interconnection Method" filed Dec. 28, 2010 by Kendrick Van Swearingen and Nahid Islam. This application is also a continuation-in-part of commonly owned co-pending U.S. Utility patent application Ser. No. 12/974,765, titled "Friction Weld Inner Conductor Cap and Interconnection Method" filed Dec. 21, 2010 by Kendrick Van Swearingen and Ronald A. Vaccaro. This application is also a continuation-in-part of commonly owned co-pending U.S. Utility patent application Ser. No. 12/962,943, titled "Friction Weld Coaxial Connector and Interconnection Method" filed Dec. 8, 2010 by Kendrick Van Swearingen. This application is also a continuation-in-part of commonly owned co-pending U.S. Utility patent application Ser. No. 12/951,558, titled "Laser Weld Coaxial Connector and Interconnection Method", filed Nov. 22, 2010 by Ronald A. Vaccaro, Kendrick Van Swearingen, James P. Fleming, James J. Wlos and Nahid Islam. Each of the above referenced applications are hereby incorporated by reference in their respective entirety.

BACKGROUND

1. Field of the Invention

This invention relates to cable connectors. More particularly, the invention relates to an interconnection interface for cable connectors utilizing interlocking tab engagement with a reduced interconnection rotation requirement to achieve a rigid interconnection.

2. Description of Related Art

A common cable type is coaxial cable. Coaxial cable connectors are used to terminate coaxial cables, for example, in communication systems requiring a high level of precision and reliability.

Connector interfaces provide a connect and disconnect functionality between a cable terminated with a connector bearing the desired connector interface and a corresponding connector with a mating connector interface mounted on an apparatus or a further cable. Typical connector interfaces utilize a threaded interconnection in which threading of a coupling nut or the like draws the connector interface pair into secure electrical, optical and/or mechanical engagement.

Where connectors are mounted in high density/close proximity to one another and/or nearby obstructions, rotating the coupling nut during threading to advance the mating portions of the connection interface may be frustrated by the adjacent objects and/or associated cables, requiring frequent resetting of the rotation tool, which increases the time and effort required to make an interconnection.

Quick connection interfaces are known which require a short rotation to engage pins into slots or the like. For example, a BNC-type connection interface for coaxial cable utilizes a spring contact to provide one hand quick connect and disconnect functionality. The BNC-type connection interface standard includes dimensional specifications that are intended for small diameter cables. As such, a BNC-type connection interface is not designed to support larger diameter and/or heavier coaxial cables and/or may create an unacceptable impedance discontinuity when utilized with a larger diameter coaxial cable. Because of the presence of the spring contact in the BNC-type connection interface, the resulting interconnection is not rigid. Therefore, the BNC-type connection interface may introduce Passive Intermodulation Distortion (PIM) to the resulting interconnection.

PIM is a form of electrical interference/signal transmission degradation that may occur with less than symmetrical interconnections and/or as electro-mechanical interconnections shift or degrade over time, for example due to mechanical stress, vibration, thermal cycling, and/or material degradation. PIM is an important interconnection quality characteristic as PIM from a single low quality interconnection may degrade the electrical performance of an entire RF system.

Competition in the cable connector market has focused attention on improving interconnection performance and long term reliability of the interconnection. Further, reduction of overall costs, including materials, training and installation costs, is a significant factor for commercial success.

Therefore, it is an object of the invention to provide a coaxial connector and method of interconnection that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
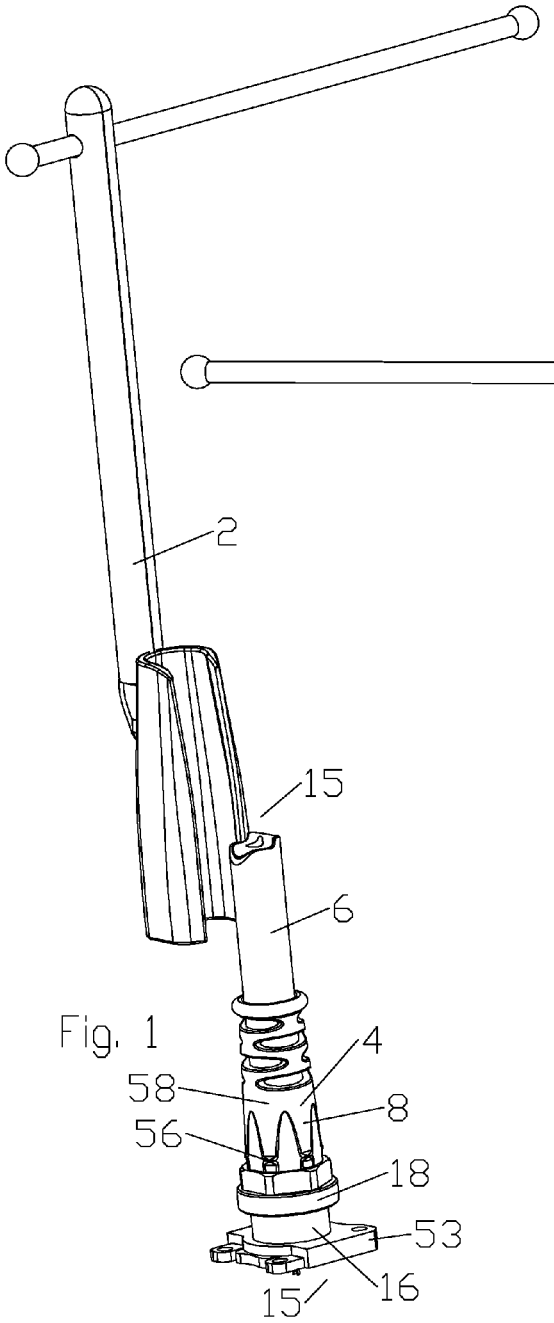
FIG. 1 is a schematic angled isometric view of an exemplary embodiment of a tabbed interconnection interface, showing a male portion coupled to a female portion, with a basin wrench.
Figure 2:
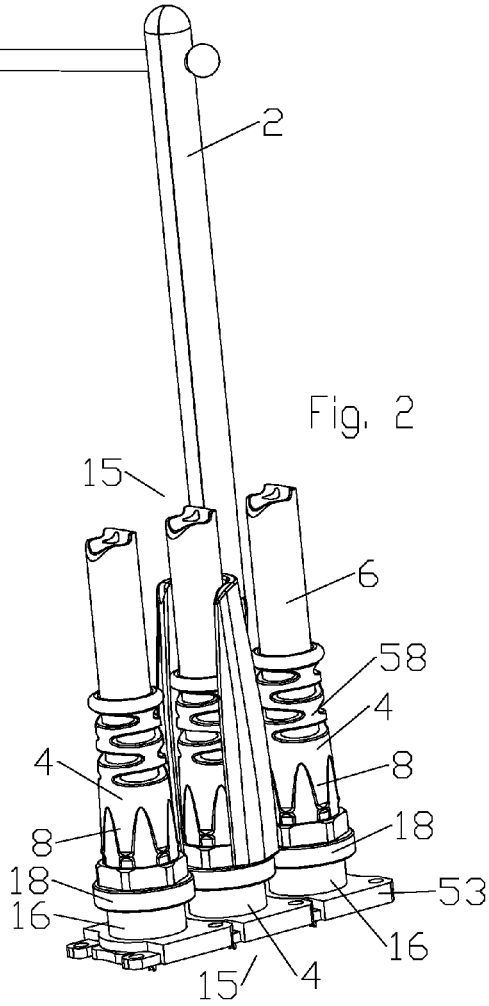
FIG. 2 is a schematic angled isometric view of the interconnection of FIG. 1, demonstrated with the connector in close proximity to adjacent connectors, with the basin wrench attached for rotation of the lock.

The inventor has recognized that threaded interconnection interfaces are particularly difficult to connect in high density/close proximity connector situations as a basin-type wrench 2 is required to access the connector 4, the wrench handle spaced away from the connector 4 along the longitudinal axis of the connector 4, for example as shown in FIGS. 1 and 2. Although it is possible to thread the connector bodies/coupling nuts together, starting the threading is difficult as the access to control how the connector bodies are aligning/seating together is frustrated and the repeated rotation required during the threading typically interferes with the cable 6 extending from the connector 4 and/or the cables 6 of adjacent connectors 4. Further, even where smaller diameter cables 6 are utilized, standard quick connection interfaces such as BNC-type interconnections may provide unsatisfactory electrical performance with respect to PIM, as the connector body may pivot laterally along the opposed dual retaining pins and internal spring element, due to the spring contact applied between the male and female portions, according to the BNC interface specification.

An exemplary embodiment of a tabbed connector interface, as shown in FIGS. 1-17, demonstrates a rigid connector interface where the male and female portions 8, 16 seat together interlocked by sets of symmetrically meshed and interlocking tabs, demonstrated in the present embodiment as sets of three tabs each.

Figure 3:
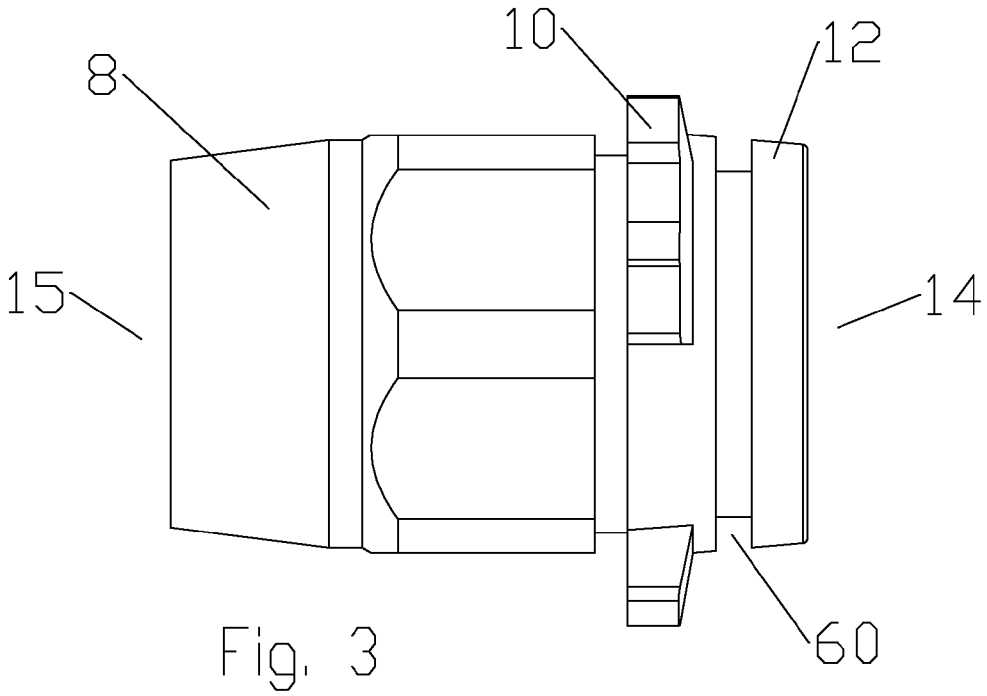
FIG. 3 is a schematic side view of a male portion of the interconnection.
Figure 4:
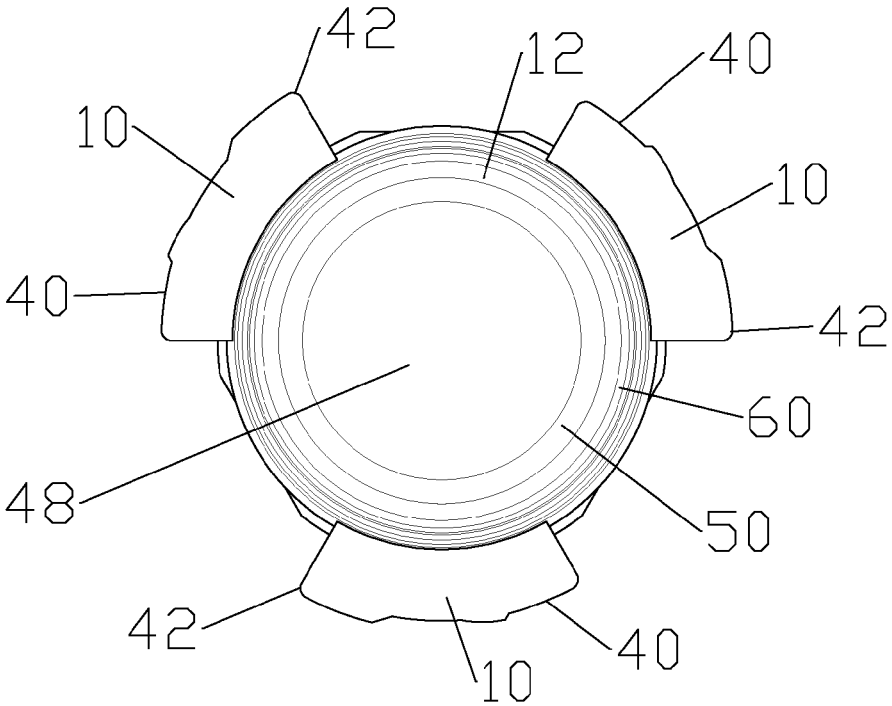
FIG. 4 is a schematic interface end view of the male portion of FIG. 3.

As best shown in FIGS. 3 and 4, a male portion 8 has, for example, three outer diameter radial projecting connector tabs 10 and a conical outer diameter seat surface 12 at an interface end 14.

One skilled in the art will appreciate that interface end 14 and cable end 15 are applied herein as identifiers for respective ends of both the connector and also of discrete elements of the connector described herein, to identify same and their respective interconnecting surfaces according to their alignment along a longitudinal axis of the connector between an interface end 14 and a cable end 15 of each of the male and female portions 8, 16. When interconnected by the connector interface, the interface end 14 of the male portion 8 is coupled to the interface end 14 of the female portion 16.

Figure 5:
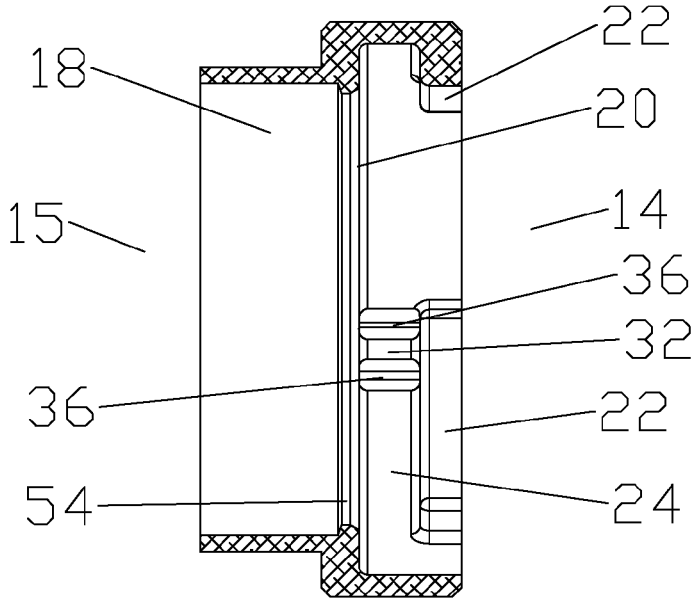
FIG. 5 is a schematic cut-away side view of the lock ring of FIG. 6.
Figure 6:
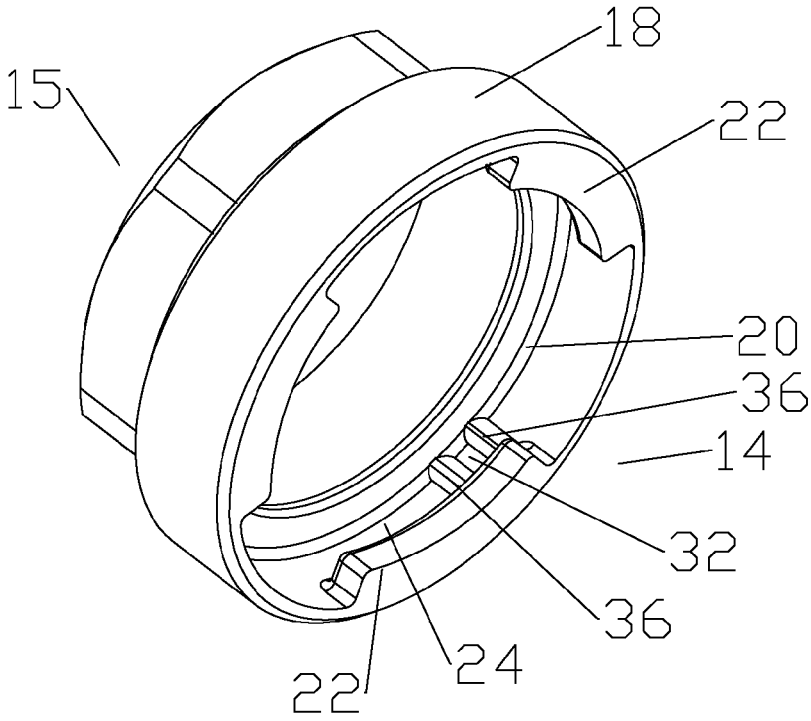
FIG. 6 is a schematic isometric view of a lock ring of the interconnection.
Figure 7:
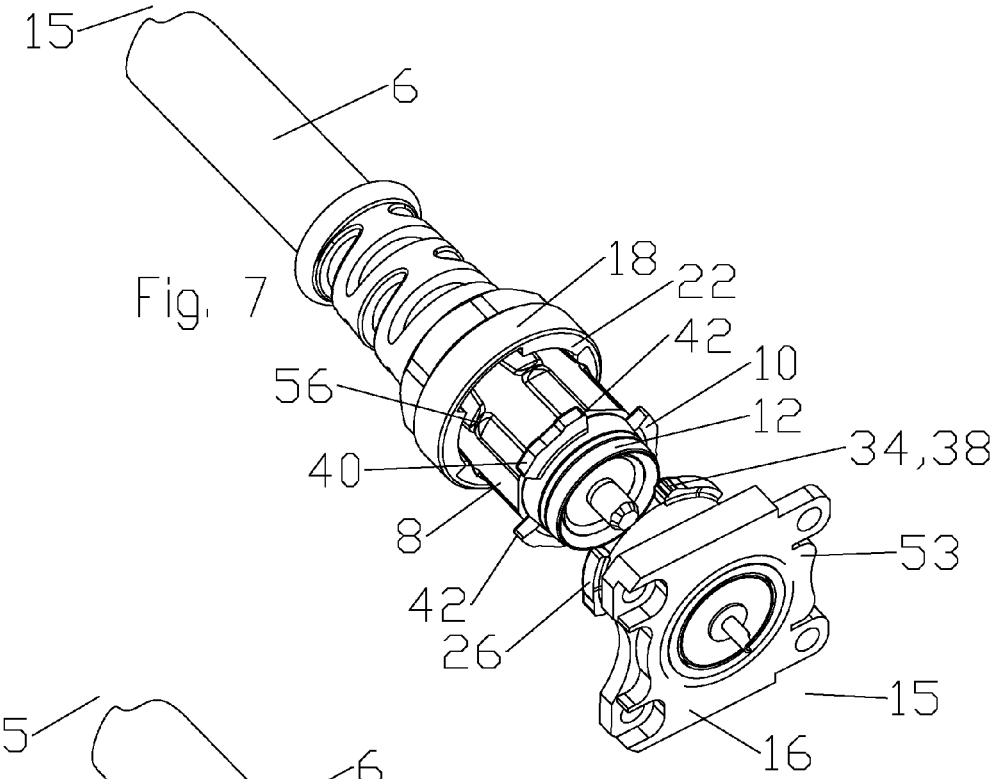
FIG. 7 is a schematic isometric view of the interconnection, prior to male portion to female portion interconnection, with the lock ring advanced towards the cable end.
Figure 8:
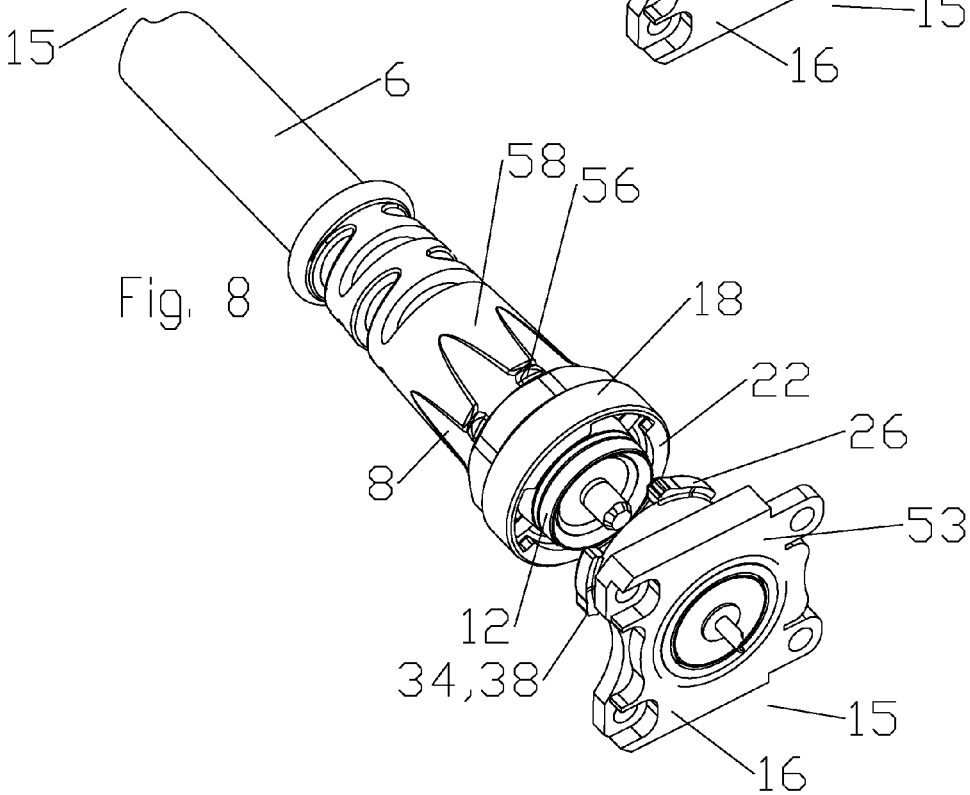
FIG. 8 is a schematic isometric view of FIG. 7, with the lock ring seated against the connector tabs and rotated so the coupling tabs are aligned with the connector tabs for initial insertion of the male portion into the female portion.
Figure 9:
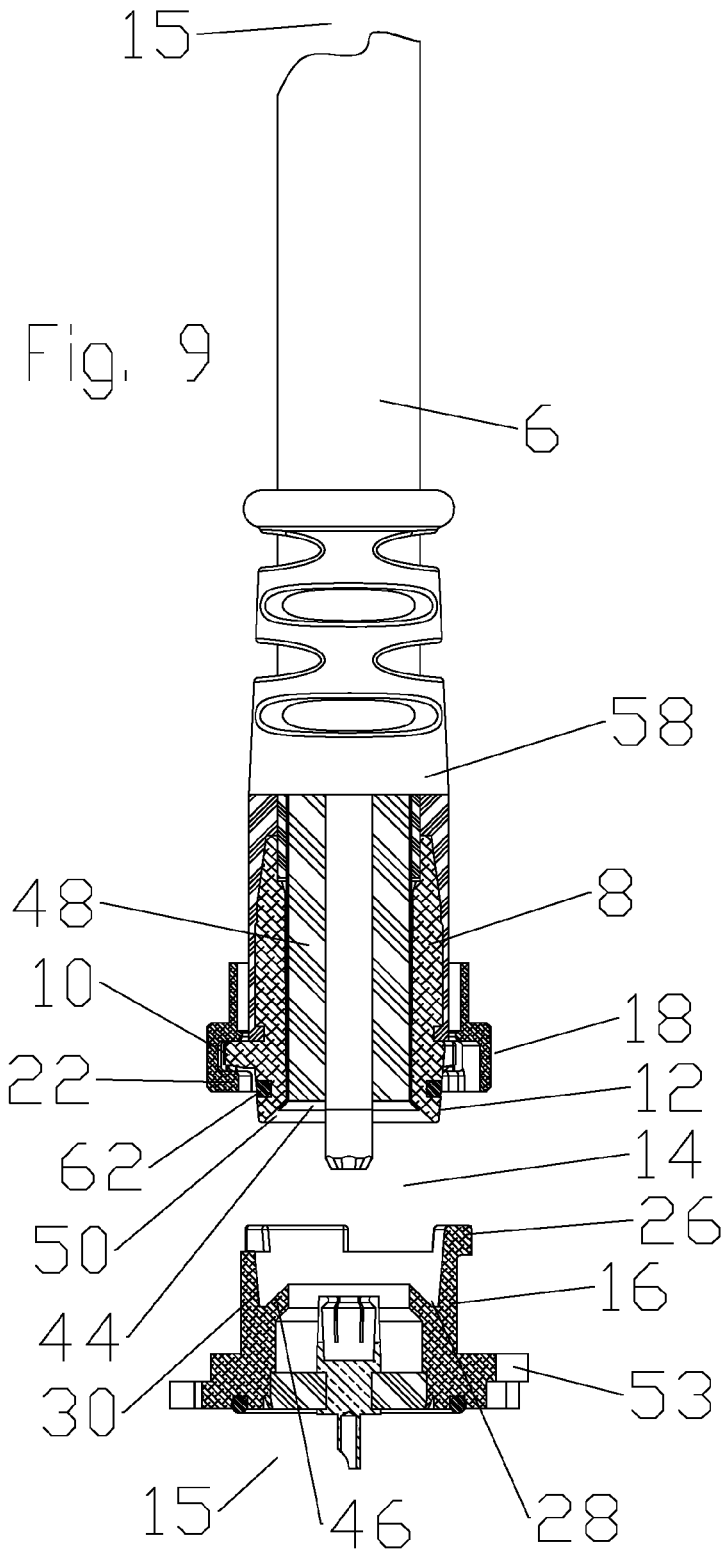
FIG. 9 is a schematic partial cut-away side view of FIG. 8.

As shown in FIGS. 5 and 6, a lock ring 18 is provided with a stop shoulder 20 and radially inward coupling tabs 22 proximate the interface end 14. The number of coupling tabs 22 corresponding to the number of connector tabs 10 applied to the male portion 8. The lock ring 18 is dimensioned to seat around the male portion 8, the stop shoulder 20 abutting the cable end 15 of the connector tabs 10. A tab seat 24 is provided between the coupling tabs 22 and the stop shoulder 20. As shown in FIG. 7, the lock ring 18 may be seated by aligning the coupling tabs 22 with spaces between each of the connector tabs 10 so that the coupling tabs 22 extend below the connector tabs 10 when the stop shoulder 20 is seated against the cable end 15 of the connector tabs 10. As shown in FIGS. 8 and 9, the lock ring 18 may then be rotated so that the coupling tabs 22 are in a shadow of the connector tabs 10, ready for insertion of the male portion 8 into the female portion 16.

Figure 10:
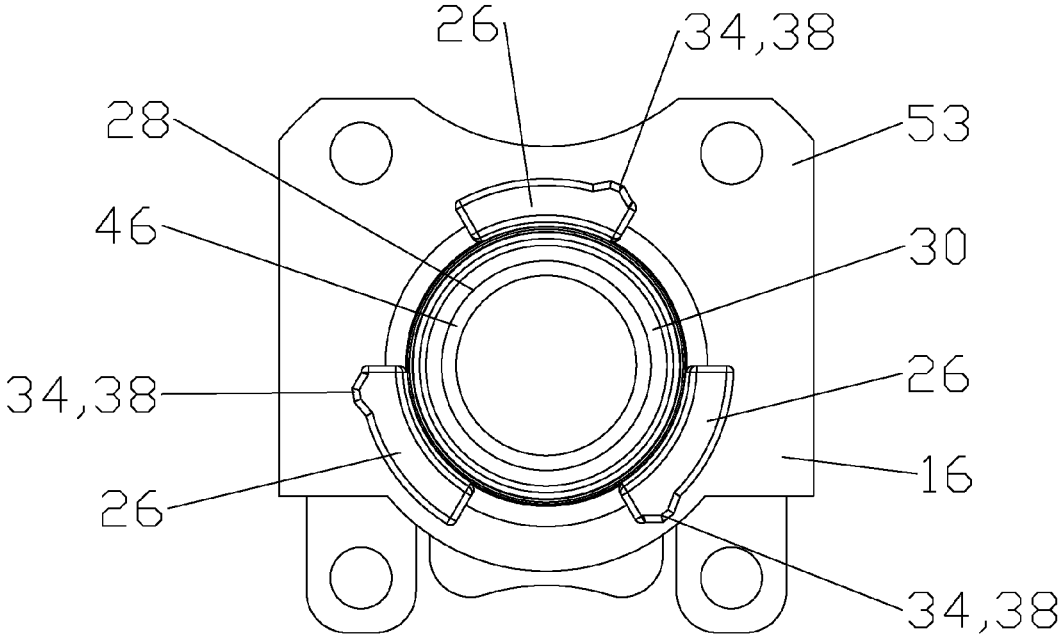
FIG. 10 is a schematic interface end view of the female portion of the interconnection.
Figure 11:
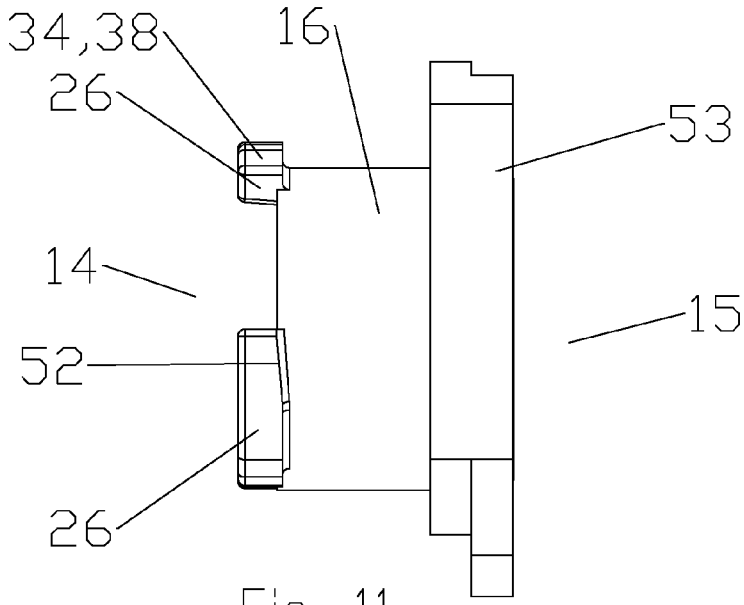
FIG. 11 is a schematic side view of the female portion of FIG. 10.

As shown in FIGS. 10 and 11, the female portion 16 is provided with a plurality of radially projecting base tabs 26, corresponding to the number of connector tabs 10, and an annular groove 28 open to the interface end 14.

Figure 12:
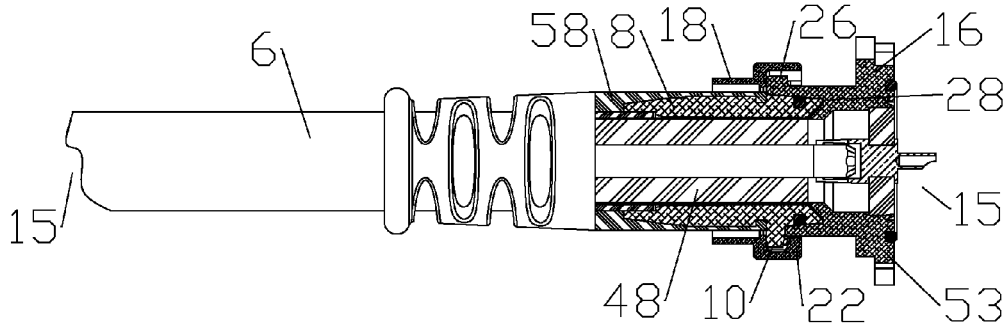
FIG. 12 is a schematic partial cut-away side view of the male portion seated within the female portion, prior to rotation of the lock ring.
Figure 13:
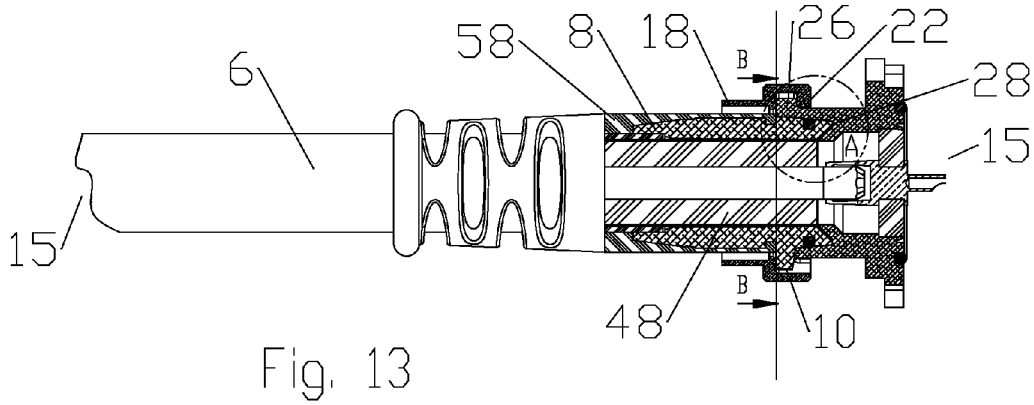
FIG. 13 is a schematic partial cut-away side view of FIG. 12, with the lock ring rotated sixty degrees to complete the interconnection.
Figure 14:
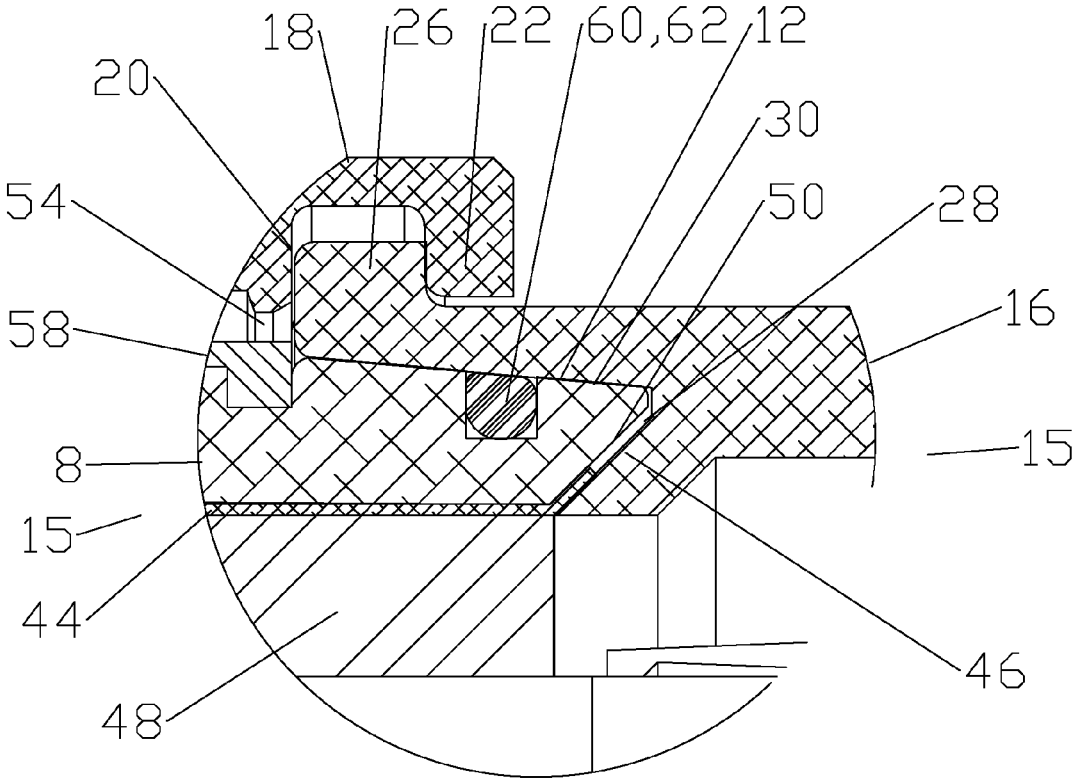
FIG. 14 is a close-up view of area A of FIG. 13

FIGS. 12-14 demonstrate engagement details as the male portion 8 is seated within the female portion 16 and the lock ring 18 rotated to secure the interconnection. As best shown in FIG. 14, an outer sidewall 30 of the annular groove 28 is dimensioned to mate with the conical outer diameter seat surface 12, providing a self-aligning conical surface to conical surface mutual seating between the male and female portions 8, 16. The base tabs 26 are dimensioned to engage the coupling tabs 22 when the base tabs 26 are inserted into the tab seat 24 as the lock ring 18 is rotated, retaining the outer diameter seat surface 12 against the outer sidewall 30 to form a rigid interconnection of the male and female portions 8, 16.

Figure 15:
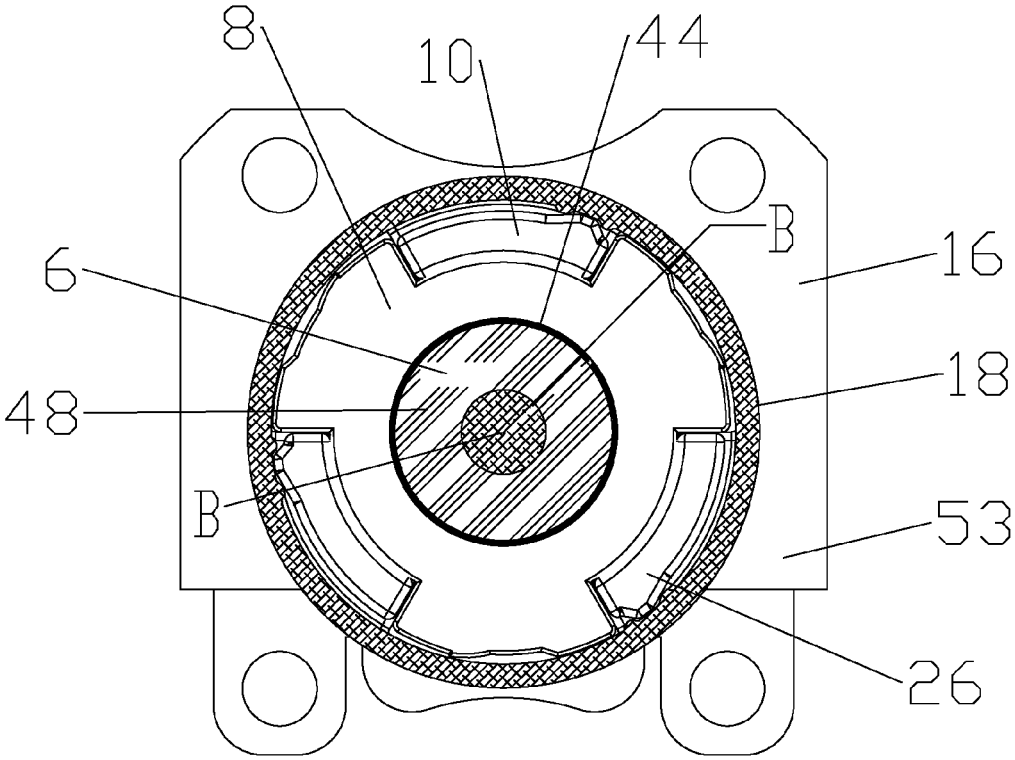
FIG. 15 is a cross-section end view of FIG. 13, along line B-B.
Figure 16:
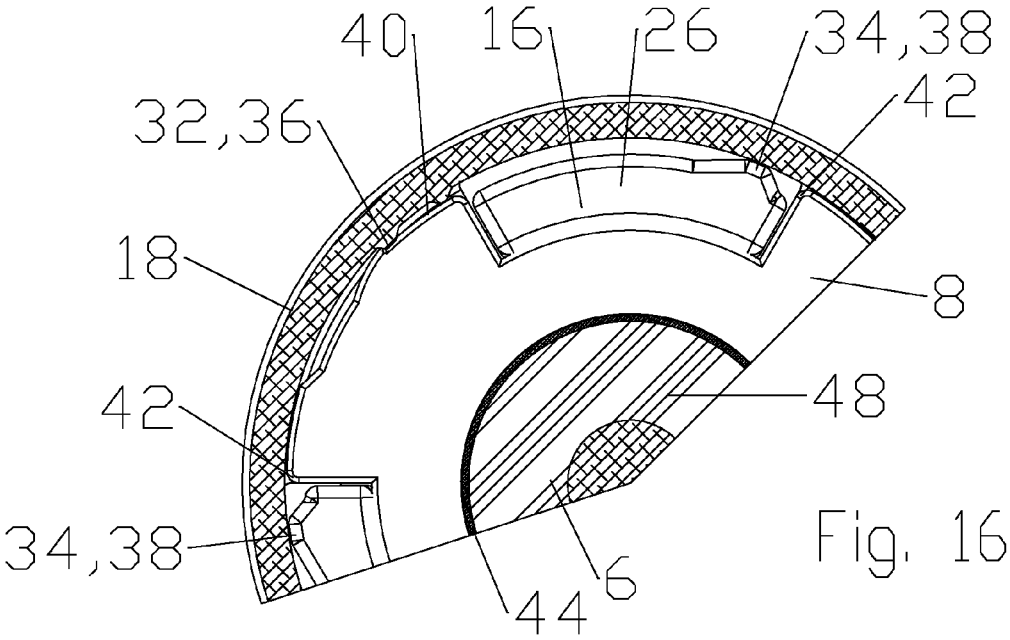
FIG. 16 is a close-up view of FIG. 15, cut along line B-B with the lock ring rotated sixty degrees to the initial insertion position.
Figure 17:
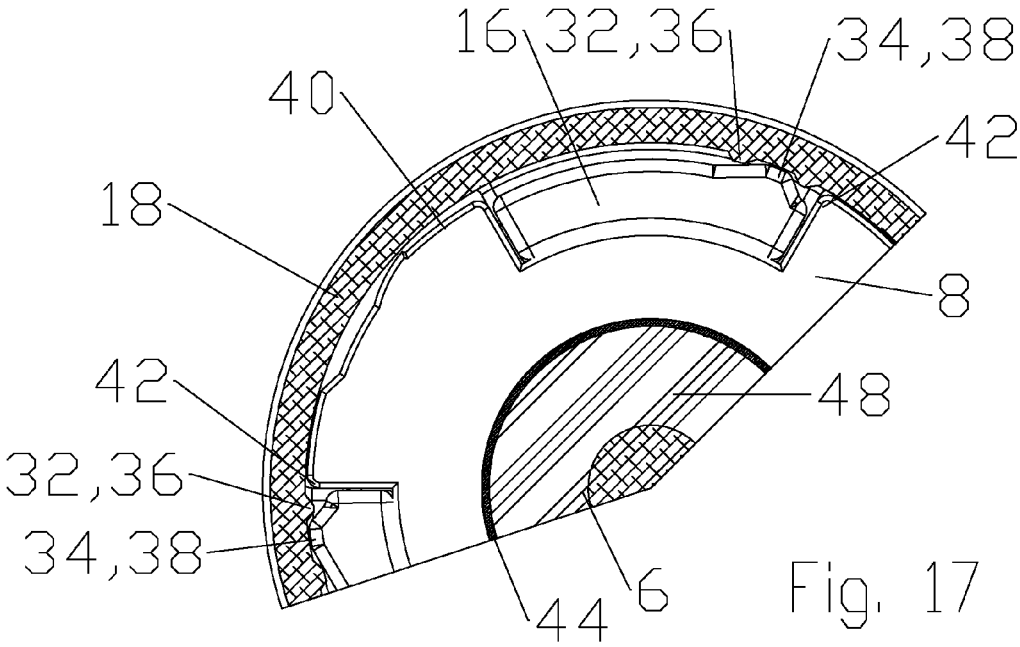
FIG. 17 is a view of FIG. 16, with the lock ring in the locked position.

The initial alignment of the lock ring 18 upon the male portion 8, for ease of male portion insertion into and seating with the female portion 16, and/or rotatability characteristics of the lock ring 18 upon interconnection, may be controlled by interlock features of the lock ring 18 and the outer diameter surfaces of the base and/or connector tabs 26, 10, for example as shown in FIGS. 15-17.

A rotation lock of the lock ring 18, retaining the lock ring 18 in the engaged position, may be created by providing a tab seat lock 32 (see FIG. 5) on a sidewall of the tab seat 24 that meshes with a base tab lock 34 (see FIG. 10) provided on an outer diameter of the base tab 26, when the lock ring 18 is rotated into the engaged position. The tab seat lock 32 may be formed, for example, as a pair of radially inward protrusions 36 which the base tab lock 34, formed as a radial outward protrusion 38, seats between.

As best shown in FIG. 16, circumferential alignment of the lock ring 18 on the male portion 8 during initial insertion may be assisted by an outer diameter insertion surface 40 dimensioned to engage the tab seat lock 32 in an interference fit, retaining the lock ring 18 aligned in an in-line insertion position with respect to the connector tabs 10 so that the base tabs 26 can mesh with the connector tabs 10 as the outer sidewall 30 of the annular groove 28 is mated with the conical outer sidewall 30, without interference from the coupling tabs 22 retained in the shadow of the connector tabs 10. The interference fit between the tab seat lock 32 and the insertion surface 40 may be provided at a level of interference which retains the lock ring 18 in place as the male portion 8 is inserted through adjacent connectors and/or cables towards the female portion 16, but which allows rotation of the lock ring 18 to slide the tab seat lock 32 away from the insertion surface 40 upon application of torque to begin the rotation of the lock ring 18 with respect to the male and female portions 8, 16 as the lock ring 18 is rotated to the engaged position during final interconnection.

As the male and female portions 8, 16 may be visually obscured by the adjacent apparatus and/or cables during interconnection, a tactile feedback that the engagement position has been reached may be provided by a click action as the base tab lock 34 drops into engagement with the tab seat lock 32. Further feedback that the engagement position has been reached may be provided by dimensioning the connector tab 10 with an outer diameter stop surface 42 dimensioned to provide a positive stop with respect to rotation of the tab seat lock 32 past the base tab lock 34 (see FIG. 17). Thereby, the installer is unable to overrotate the lock ring 18 past the engagement position.

The cable end 15 of the base tabs 26 and/or coupling tabs 22 may be provided with an angled engagement surface 52 (see FIG. 11) for ease of initial engagement therebetween. Thereby, as the lock ring 18 is rotated, the coupling tab 22 is driven against the angled engagement surface 52 and the coupling tab 22 is progressively drawn toward the cable end 15 as the coupling tab 22 advances along the engagement surface 52, driving the male portion 8 into engagement with the female portion 16.

One skilled in the art will appreciate that the connector tabs 10 mesh with the base tabs 26 as the outer diameter seat surface 12 is seated against the outer sidewall 30 (see FIG. 15), inhibiting rotation of the male portion 8 with respect to the female portion 16, allowing the lock ring 18 to be rotated without requiring an additional tool to inhibit rotation of the male portion 8, for example where the female portion 16 is configured for panel surface mounting via a mounting flange 53.

The stop shoulder 20 of the lock ring 18 may be formed with a retention lip 54 that projects radially inward (see FIG. 5). Thereby, the retention lip 54 may engage a corresponding radially outward protruding retention spur 56 of the male portion 8 (see FIG. 7), retaining the lock ring 18 upon the male portion 8 at the cable end 15. The retention spur 56 may be formed directly in the outer diameter of the male portion 8 or alternatively on an overbody 58 covering an outer diameter of the male portion 8 between the cable end 15 and the connector tabs 10. The overbody 58 may be sealed against a jacket of the cable 6 to provide both an environmental seal for the cable end of the interconnection and a structural reinforcement of the cable 6 to male portion 8 interconnection.

Returning to FIG. 14, a further environmental seal may be formed by applying an annular seal groove 60 in the outer diameter seat surface 12, in which a seal 62 such as an elastometric o-ring or the like may be seated. Because of the conical mating between the outer diameter seat surface 12 and the outer side wall 30, the seal 62 may experience reduced insertion friction compared to that encountered when seals are applied between telescoping cylindrical surfaces, enabling the seal 62 to be slightly over-sized, which may result in an improved environmental seal between the outer diameter seat surface 12 and the outer side wall 30.

The present embodiment demonstrates a coaxial cable outer conductor 44 to connector 4 interconnection in the male portion 8 which passes the outer conductor 44 through the male portion 8 into direct contact with the female portion 16, circumferentially clamped at the interconnection therebetween. Thereby, the several additional connector elements and/or internal connections common in conventional coaxial connectors with a cable to connector retention based upon interconnection with the outer conductor 44 may be eliminated. As best shown in FIG. 14, an inner sidewall 46 of the annular groove 28 is dimensioned to seat against a flared end of the outer conductor 44 of the coaxial cable 6 inserted through a bore 48 of the male portion 8, clamping the outer conductor 44 between the male and female portions 8, 16 when the outer diameter seat surface 12 is seated against the outer sidewall 30. One skilled in the art will appreciate that a direct pass through of the outer conductor 44 eliminates potential PIM sources present between each additional surface/contact point present in a conventional coaxial cable connector termination.

The inventor has recognized that, in contrast to traditional mechanical, solder and/or conductive adhesive interconnections, a molecular bond type interconnection reduces aluminum oxide surface coating issues, PIM generation and improves long term interconnection reliability.

A "molecular bond" as utilized herein is defined as an interconnection in which the bonding interface between two elements utilizes exchange, intermingling, fusion or the like of material from each of two elements bonded together. The exchange, intermingling, fusion or the like of material from each of two elements generates an interface layer where the comingled materials combine into a composite material comprising material from each of the two elements being bonded together.

One skilled in the art will recognize that a molecular bond may be generated by application of heat sufficient to melt the bonding surfaces of each of two elements to be bonded together, such that the interface layer becomes molten and the two melted surfaces exchange material with one another. Then, the two elements are retained stationary with respect to one another, until the molten interface layer cools enough to solidify.

The resulting interconnection is contiguous across the interface layer, eliminating interconnection quality and/or degradation issues such as material creep, oxidation, galvanic corrosion, moisture infiltration and/or interconnection surface shift.

A molecular bond between the outer conductor 44 of the cable 6 and the male portion 8 may be generated via application of heat to the desired interconnection surfaces between the outer conductor 44 and the male portion 8, for example via laser or friction welding. Friction welding may be applied, for example, as spin and/or ultrasonic type welding.

Even if the outer conductor 44 is molecular bonded to the male portion 8, it may be desirable to prevent moisture or the like from reaching and/or pooling against the outer diameter of the outer conductor 44, between the male portion 8 and the cable 6.

Ingress paths between the male portion 8 and cable 6 at the cable end 15 may be permanently sealed by applying a molecular bond between polymer material of the overbody 58 and a jacket of the cable 6. The overbody 58, as shown for example in FIG. 9, may be applied to the male portion 8 as an overmolding of polymeric material.

The cable end 15 of the overbody 58 may be dimensioned with an inner diameter friction surface proximate that of the jacket, that creates an interference fit with respect to an outer diameter of the jacket, enabling a molecular bond between the overbody 30 and the jacket, by friction welding rotation of the male portion 8 with respect to the outer conductor 44, thereby eliminating the need for environmental seals at the cable end 15 of the male portion 8.

The overbody 58 may provide a significant strength and protection characteristic to the mechanical interconnection.

The overbody 58 may also have an extended cable portion proximate the cable end provided with a plurality of stress relief control apertures, for example as shown in FIG. 9. The stress relief control apertures may be formed in a generally elliptical configuration with a major axis of the stress relief control apertures arranged normal to the longitudinal axis of the male portion 8. The stress relief control apertures enable a flexible characteristic of the cable end 15 of the overbody 58 that increases towards the cable end 15 of the overbody 58. Thereby, the overbody 58 supports the interconnection between the cable 6 and the male portion 8 without introducing a rigid end edge along which the connected cable 6 subjected to bending forces may otherwise buckle, which may increase both the overall strength and the flexibility characteristics of the interconnection.

Prior to interconnection, the leading end of the cable 6 may be prepared by cutting the cable 6 so that inner conductor(s) extend from the outer conductor 44. Also, a dielectric material that may be present between the inner conductor(s) and outer conductor 44 may be stripped back and a length of the outer jacket removed to expose desired lengths of each. The inner conductor may be dimensioned to extend through the attached coaxial connector 2 for direct interconnection with the female portion 16 as a part of the connection interface. Alternatively, for example where the connection interface selected requires an inner conductor profile that is not compatible with the inner conductor of the selected cable 6 and/or where the material of the inner conductor is an undesired inner conductor connector interface material, such as aluminum, the inner conductor may be terminated by applying an inner conductor cap.

An inner conductor cap, for example formed from a metal such as brass, bronze or other desired metal, may be applied with a molecular bond to the end of the inner conductor, also by friction welding such as spin or ultrasonic welding. The inner conductor cap may be provided with an inner conductor socket at the cable end 15 and a desired inner conductor interface at the interface end 14. The inner conductor socket may be dimensioned to mate with a prepared end of an inner conductor of the cable 6. To apply the inner conductor cap, the end of the inner conductor may be prepared to provide a pin profile corresponding to the selected socket geometry of the inner conductor cap. To allow material inter-flow during welding attachment, the socket geometry of the inner conductor cap and/or the end of the inner conductor may be formed to provide a material gap when the inner conductor cap is seated upon the prepared end of the inner conductor.

A rotation key may be provided upon the inner conductor cap, the rotation key dimensioned to mate with a spin tool or a sonotrode for rotating and/or torsionally reciprocating the inner conductor cap, for molecular bond interconnection via spin or ultrasonic friction welding.

Alternatively, the inner conductor cap may be applied via laser welding applied to a seam between the outer diameter of the inner conductor and an outer diameter of the cable end 15 of the inner conductor cap.

A molecular bond between the male portion 8 and outer conductor 44 may be formed by inserting the prepared end of the cable 6 into the bore 48 so that the outer conductor 44 is flush with the interface end 14 of the bore 48, enabling application of a laser to the circumferential joint between the outer diameter of the outer conductor 44 and the inner diameter of the bore 48 at the interface end 14.

Prior to applying the laser to the outer conductor 44 and bore 48 joint, a molecular bond between the overbody 58 and the jacket may be applied by spinning the male portion 8 and thereby a polymer overbody 58 applied to the outer diameter of the male portion 8 with respect to the cable 6. As the overbody 58 is rotated with respect to the jacket, the friction surface is heated sufficient to generate a molten interface layer which fuses the overbody 58 and jacket to one another in a circumferential molecular bond when the rotation is stopped and the molten interface layer allowed to cool.

With the overbody 58 and jacket molecular bonded together, the laser may then be applied to the circumference of the outer conductor 44 and bore 48 joint, either as a continuous laser weld or as a series of overlapping point welds until a circumferential molecular bond has been has been obtained between the male portion 8 and the outer conductor 44. Alternatively, the bore 48 may be provided with an inward projecting shoulder proximate the interface end 14 of the bore 48, that the outer conductor 44 is inserted into the bore 48 to abut against and the laser applied at an angle upon the seam between the inner diameter of the outer conductor end and the inward projecting shoulder, from the interface end 15.

Alternatively, a molecular bond may be formed via ultrasonic welding by applying ultrasonic vibrations under pressure in a join zone between two parts desired to be welded together, resulting in local heat sufficient to plasticize adjacent surfaces that are then held in contact with one another until the interflowed surfaces cool, completing the molecular bond. An ultrasonic weld may be applied with high precision via a sonotrode and/or simultaneous sonotrode ends to a point and/or extended surface. Where a point ultrasonic weld is applied, successive overlapping point welds may be applied to generate a continuous ultrasonic weld. Ultrasonic vibrations may be applied, for example, in a linear direction and/or reciprocating along an arc segment, known as torsional vibration.

An outer conductor molecular bond with the male portion 8 via ultrasonic welding is demonstrated in FIG. 9. A flare surface 50 angled radially outward from the bore 6 toward the interface end 14 of the male portion 8 is open to the interface end 14 of the male portion 8, providing a mating surface to which a leading end flare of the outer conductor 44 may be ultrasonically welded by an outer conductor sonotrode of an ultrasonic welder inserted to contact the leading end flare from the interface end 14.

The prepared end of the cable 6 is inserted through the bore 48 and an annular flare operation is performed on a leading edge of the outer conductor 44. The resulting leading end flare may be angled to correspond to the angle of the flare seat 50 with respect to a longitudinal axis of the male portion 8. By performing the flare operation against the flare surface 50, the resulting leading end flare can be formed with a direct correspondence to the flare surface angle. The flare operation may be performed utilizing the leading edge of an outer conductor sonotrode, provided with a conical cylindrical inner lip with a connector end diameter less than an inner diameter of the outer conductor 48, for initially engaging and flaring the leading edge of the outer conductor 44 against the flare surface 50.

The flaring operation may be performed with a separate flare tool or via advancing the outer conductor sonotrode to contact the leading edge of the head of the outer conductor 44, resulting in flaring the leading edge of the outer conductor 44 against the flare surface 50. Once flared, the outer conductor sonotrode is advanced (if not already so seated after flaring is completed) upon the leading end flare and ultrasonic welding may be initiated.

Ultrasonic welding may be performed, for example, utilizing linear and/or torsional vibration. In linear vibration ultrasonic-type friction welding of the leading end flare to the flare surface 50, a linear vibration is applied to an interface end side of the leading end flare, while the male portion 8 and flare surface 50 there within are held static within a fixture. The linear vibration generates a friction heat which plasticizes the contact surfaces between the leading end flare and the flare surface 50, forming a molecular bond upon cooling. Where linear vibration ultrasonic-type friction welding is utilized, a suitable frequency and linear displacement, such as between 20 and 40 KHz and 20-35 microns, selected for example with respect to a material characteristic, diameter and/or sidewall thickness of the outer conductor 44, may be applied.

In alternative embodiments the interconnection between the cable 6 and the male and/or female portions 8, 16 may be applied more conventionally, for example utilizing clamp-type and/or soldered interconnections well known in the art.

The exemplary embodiment is demonstrated with respect to a cable 6 that is an RF-type coaxial cable. One skilled in the art will appreciate that the connection interface may be similarly applied to any desired cable 6, for example multiple conductor cables, power cables and/or optical cables, by applying suitable conductor mating surfaces/individual conductor interconnections aligned within the bore 48 of the male and female portions 8, 16.

The exemplary embodiment is demonstrated with three connector tabs 10, coupling tabs 22 and base tabs 26. A three tab configuration provides a sixty degree rotation engagement characteristic. That is, the interconnection may be fully engaged by rotating the lock ring 18 sixty degrees with respect to the female portion 16. Further, the symmetrical distribution of the tabs provides symmetrical support to the interconnection along the longitudinal axis.

One skilled in the art will appreciate that the number of tabs may be increased, resulting in a proportional decrease in the rotation engagement characteristic. As the number of tabs is increased a tradeoff may apply in that the area available on the base tabs 26 for an engagement surface 52 decreases, which may require a steeper engagement surface angle to be applied and/or otherwise complicate initial engagement characteristics. Further, as the dimensions of the individual tabs decrease, materials with increased strength characteristics may be required.

One skilled in the art will further appreciate that the tabbed connector interface provides a quick connect rigid interconnection with a reduced number of discrete elements, which may simplify manufacturing and/or assembly requirements. Contrary to conventional connection interfaces featuring threads, the conical aspect of the seat surface 12 is generally self-aligning, allowing interconnection to be initiated without precise initial male to female portion 8, 16 alignment along the longitudinal axis.

Table of Parts

| | |
|---|---|
| 2 | wrench |
| 4 | connector |
| 6 | cable |
| 8 | male portion |
| 10 | connector tab |
| 12 | seat surface |
| 14 | interface end |
| 15 | cable end |
| 16 | female portion |
| 18 | lock ring |
| 20 | stop shoulder |
| 22 | coupling tab |
| 24 | tab seat |
| 26 | base tab |
| 28 | annular groove |

-continued

Table of Parts

| | |
|---|---|
| 30 | outer sidewall |
| 32 | tab seat lock |
| 34 | base tab lock |
| 36 | inward protrusion |
| 38 | outward protrusion |
| 40 | insertion surface |
| 42 | stop surface |
| 44 | outer conductor |
| 46 | inner sidewall |
| 48 | bore |
| 50 | flare surface |
| 52 | engagement surface |
| 53 | mounting flange |
| 54 | retention lip |
| 56 | retention spur |
| 58 | overbody |
| 60 | seal groove |
| 62 | seal |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A cable connector interface, comprising:

a male portion with at least three outer diameter radially projecting connector tabs; the male portion provided with a conical outer diameter seat surface at an interface end;

a lock ring provided with a stop shoulder and at least three radially inward coupling tabs at the interface end; the lock ring dimensioned to seat around the male portion, the stop shoulder abutting a cable end of the connector tabs; a tab seat provided between the coupling tabs and the stop shoulder;

a female portion with at least three outer diameter radial projecting base tabs, and an annular groove open to the interface end with an outer sidewall dimensioned to mate with the conical outer diameter seat surface; the base tabs dimensioned to engage the coupling tabs when the base tabs are inserted into the tab seat and the lock ring is rotated, retaining the conical outer diameter seat surface against the outer sidewall.

2. The connector interface of claim 1, further including a tab seat lock on a sidewall of the tab seat and a base tab lock on an outer diameter of the base tab; the tab seat lock and the base tab lock dimensioned to mesh with one another when the base tabs are inserted into the tab seat, inhibiting rotation of the lock ring.

3. The connector interface of claim 2, wherein the connector tab is provided with an outer diameter insertion surface dimensioned to engage the tab seat lock in an interference fit, retaining the lock ring aligned in an insertion position with respect to the connector tabs.

4. The connector interface of claim 2, wherein the connector tab is provided with an outer diameter stop surface dimensioned to provide a positive stop with respect to rotation of the tab seat lock past the base tab lock.

5. The connector interface of claim 1, wherein an inner sidewall of the annular groove is dimensioned to seat against a flared end of an outer conductor of a coaxial cable inserted through a bore of the male portion, clamping the outer conductor against the male portion when the outer diameter seat surface is seated against the outer sidewall.

6. The connector interface of claim 1, wherein a cable end of the base tab is provided with an angled engagement surface; the engagement surface progressively drawing the coupling tab and thereby the male portion towards the female portion as the lock ring is rotated.

7. The connector interface of claim 1, wherein the connector tabs mesh with the base tabs as the conical outer diameter seat surface is seated against the outer sidewall, inhibiting rotation of the male portion with respect to the female portion.

8. The connector interface of claim 1, wherein the stop shoulder has a radially inward projecting retention lip; the retention lip engaging a radial outward protruding retention spur of the male portion, retaining the lock ring upon the male portion.

9. The connector interface of claim 8, wherein the retention spur is provided on an overbody covering an outer diameter of the male portion between the cable end and the connection tabs.

10. The connector interface of claim 1, further including an annular groove provided in the conical outer diameter seat surface, in which a seal is seated.

11. The connector interface of claim 1, wherein the male portion is coupled to an outer conductor of a cable by a molecular bond between the outer conductor and the male portion.

12. A method for interconnecting an electrical connector, comprising the steps of:

providing a male portion with at least three outer diameter radially projecting connector tabs; the male portion provided with a conical outer diameter seat surface at an interface end;

seating a lock ring around the male portion, a stop shoulder of the lock ring abutting a cable end of the connector tabs; the lock ring provided with at least three radially inward coupling tabs at the interface end; a tab seat provided between the coupling tabs and the stop shoulder;

inserting the interface end of the male portion into an interface end of a female portion with at least three outer diameter radially projecting base tabs, and an annular groove open to the interface end with an outer sidewall dimensioned to mate with the conical outer diameter seat surface; and rotating the lock ring so that the base tabs engage the coupling tabs, inserting the base tabs into the tab seat, thereby retaining the conical outer diameter seat surface against the outer sidewall.

13. The method of claim 12, wherein a tab seat lock is provided on a sidewall of the tab seat and a base tab lock is provided on an outer diameter of the base tab; the tab seat lock and the base tab lock dimensioned to mesh with one another when the base tabs are inserted into the tab seat, inhibiting rotation of the lock ring out of a locked position.

14. The method of claim 13, wherein the base tab is provided with an outer diameter insertion surface dimensioned to engage the tab seat lock in an interference fit, retaining the lock ring aligned in an insertion position with respect to the connector tabs, prior to initiation of rotation.

15. The method of claim 13, wherein the connector tab is provided with an outer diameter stop surface dimensioned to provide a positive stop with respect to rotation of the tab seat lock past the base tab lock.

16. The method of claim 12, wherein an inner sidewall of the annular groove is dimensioned to seat against a flared end of an outer conductor of a coaxial cable inserted through a bore of the male portion, clamping the outer conductor against the male portion when the conical outer diameter seat surface is seated against the outer sidewall.

17. The method of claim 16, further including the step of forming a molecular bond between the flared end of the outer conductor and a flare surface of a bore of the male portion.

18. The method of claim 11, wherein a cable end of the base tab is provided with an angled engagement surface; the engagement surface progressively drawing the coupling tab and thereby the male portion towards the female portion as the lock ring is rotated.

19. The method of claim 11, wherein the connector tabs mesh with the base tabs as the conical outer diameter seat surface is seated against the outer sidewall, inhibiting rotation of the male portion with respect to the female portion.

20. The method of claim 11, further including an annular groove provided in the conical outer diameter seat surface, in which a seal is seated.

* * * * *